US006269569B1

(12) United States Patent
Doone

(10) Patent No.: US 6,269,569 B1
(45) Date of Patent: Aug. 7, 2001

(54) ALUMINUM STRETCHER FRAME SYSTEM

(76) Inventor: Charles Ian Doone, 1530 W. Boynton Beach Blvd., Boynton Beach, FL (US) 33436

( * ) Notice: Subject to any disclaimer, the term of this patent is extended or adjusted under 35 U.S.C. 154(b) by 0 days.

(21) Appl. No.: 09/514,938

(22) Filed: Feb. 28, 2000

(51) Int. Cl.[7] ..... G09F 17/00
(52) U.S. Cl. ..... 40/603; 40/780
(58) Field of Search ..... 40/603, 604, 780, 40/782, 783, 784, 785

(56) References Cited

U.S. PATENT DOCUMENTS 1,335,854 * 4/1920 O'Callahan ..... 40/603
3,885,335 * 5/1975 Egermayer ..... 40/603
4,754,566 * 7/1988 Gordon ..... 40/603
4,773,174 * 9/1988 Boeniger et al. ..... 40/603
5,301,447 * 4/1994 Lotter et al. ..... 40/603
5,467,546 * 11/1995 Kovalak, Jr. ..... 40/603
5,893,227 * 4/1999 Johansson et al. ..... 40/603
6,163,995 * 12/2000 Lucchetti et al. ..... 40/603

* cited by examiner

*Primary Examiner*—B. Dayoan
*Assistant Examiner*—William L. Miller

(57) ABSTRACT

This is a rigid aluminum frame system designed so that printed, applied art or graphic art on canvas or vinyl may be applied to the frame. Rectangular or square frames attach to interior or exterior walls. The frames project two inches from the wall, with lengths cut to size up to sixteen feet. The canvas or vinyl wraps and covers the front and all edges of the frame. The frames fit tightly to the wall with no visible fasteners.

1 Claim, 6 Drawing Sheets

ALUMINUM STRETCHER FRAME SYSTEM

My lightweight, rigid, aluminum stretcher frame system is designed for the application of artist canvas and sheet vinyl. This is a new method intended for the professional artist and sign manufacturer for mounting original art, printed art, photo art, printed graphic arts and applied graphic arts.

The frames are designed for interior and exterior use. The frames are cut to size with rail lengths up to sixteen feet that make square or rectangular shaped frames. The frames project two inches from the wall and fit tightly to the wall with no visible fasteners. The finish material wraps the front and all edges of the frame and requires no additional framing. The frames have an architectural appearance once mounted to the wall.

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

BACKGROUND OF THE INVENTION

My frame system is designed for the professional artist and sign manufacturers. The fames are designed for mounting original, printed, photo, printed graphic and applied graphic arts on canvas or vinyl.

I know of no documents that would relate to this invention. To my knowledge this would be a new concept for applying canvas or vinyl to a stretcher frame.

BRIEF SUMMARY OF THE INVENTION

There are numerous advantages to my aluminum stretcher frame system. It provides a new concept of mounting preprinted, applied art or graphic art on canvas or vinyl to a large, lightweight, trim frame. The frames are cut to size, project only two inches and they fit tightly to the wall without any visible fasteners. The finish material covers the front and wraps around all edges of the frame and the canvas or vinyl attaches on the back of the frame. The corners of the frame are designed to tuck and cap the canvas in the corners of the frame. The finish material attaches and is removed easily. The frames are a knock down design making it possible to ship. The frames are designed for interior and exterior use. They require common tools to assemble and mount and they require no stapling, sewing, or gluing

DETAILED DESCRIPTION OF THE INVENTION

Referring particularly to FIGS. 1–12, aluminum stretcher frame system.

Figure 1:
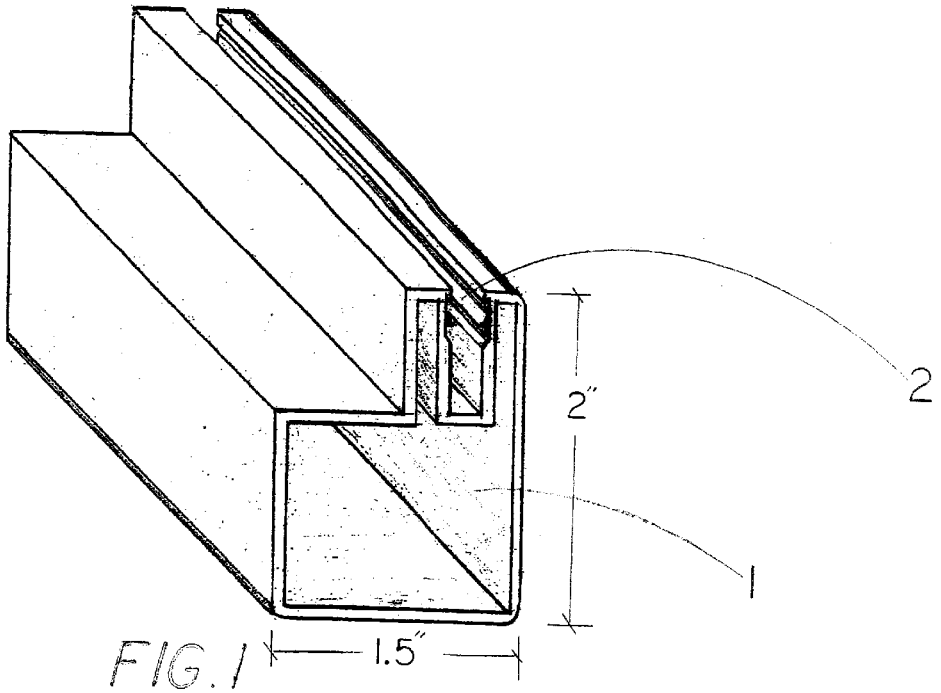
FIG. 1) End view of rail.

FIG. 1, shows an end view of an aluminum rail. The rail is shown face down, showing the (1) opening for the corner piece and the (2) groove for the canvas or vinyl. The top, bottom, and both end rails are cut to length to form square or rectangular frames cut from sixteen foot lengths.

Figure 2:
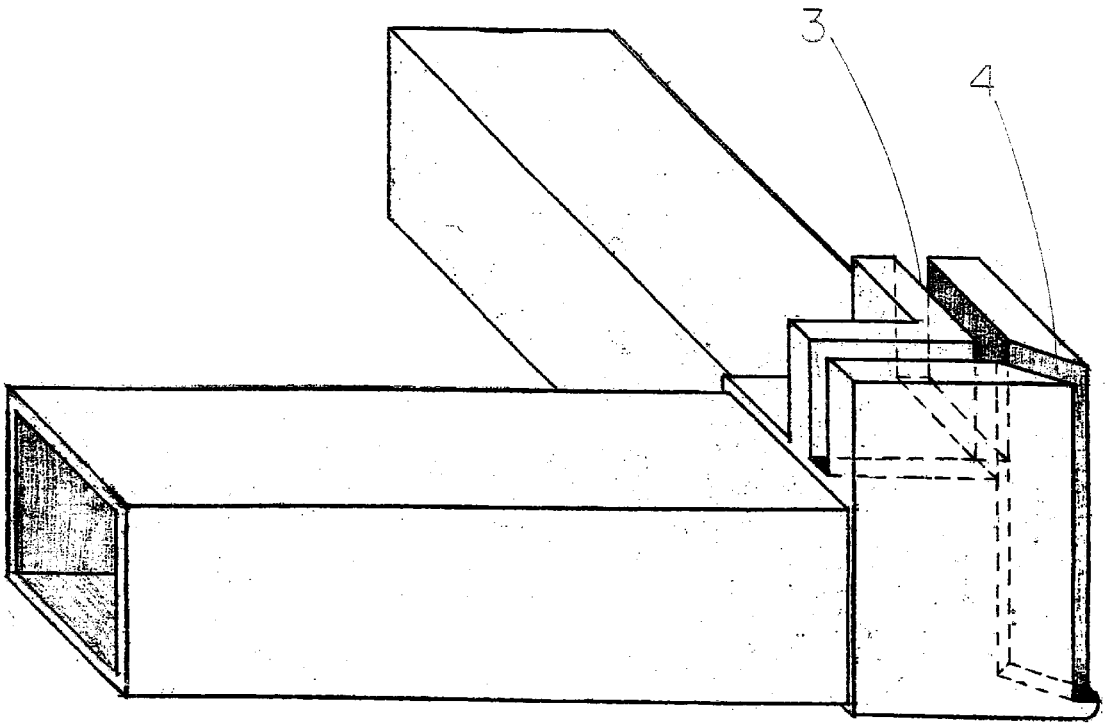
FIG. 2) View of corned piece.

FIG. 2, shows an aluminum corner piece. The corner pieces slide into the ends of the rails and the rails and corner pieces are drilled thru, counter sunk on outside edge of rail then fastened together with self tapping screws. The corner pieces are (3) grooved on the back and grooved on a (4) 45 degree angle in the corner.

Figure 3:
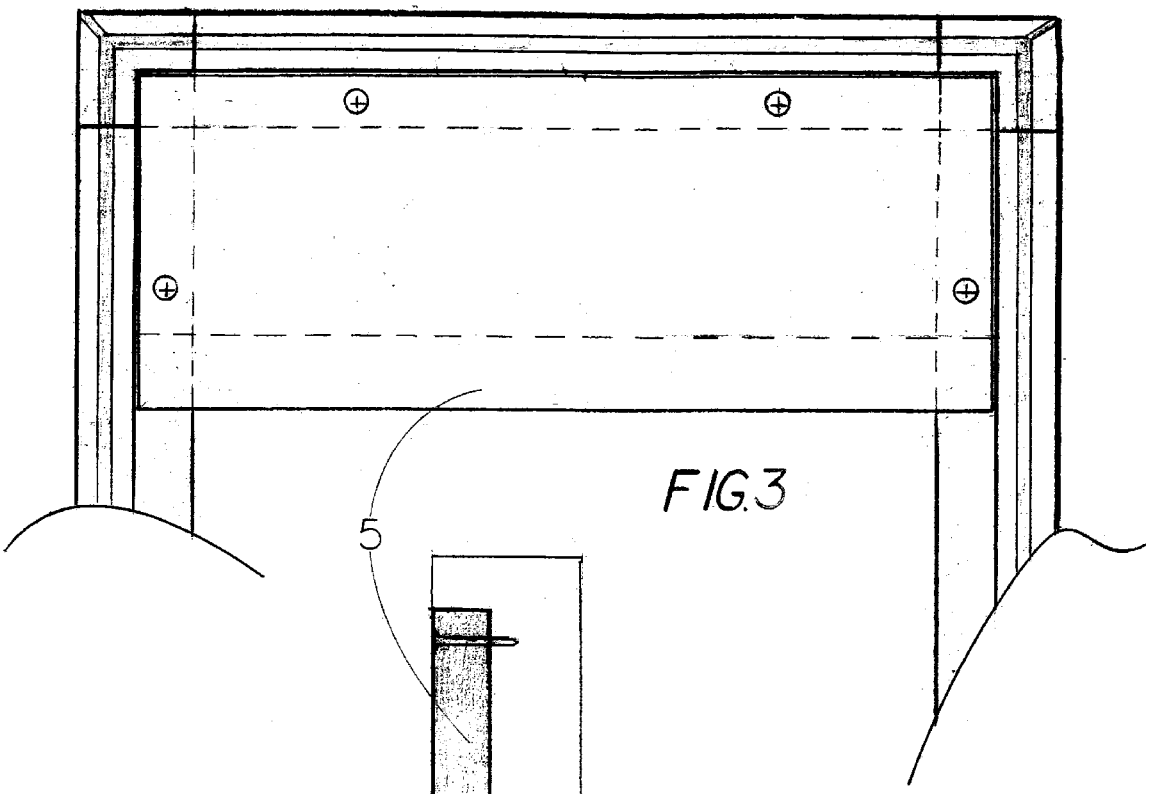
FIG. 3) Back view of frame cleat.

FIG. 3, shows a (5) frame cleat attached to the back of a frame.

Figure 4:
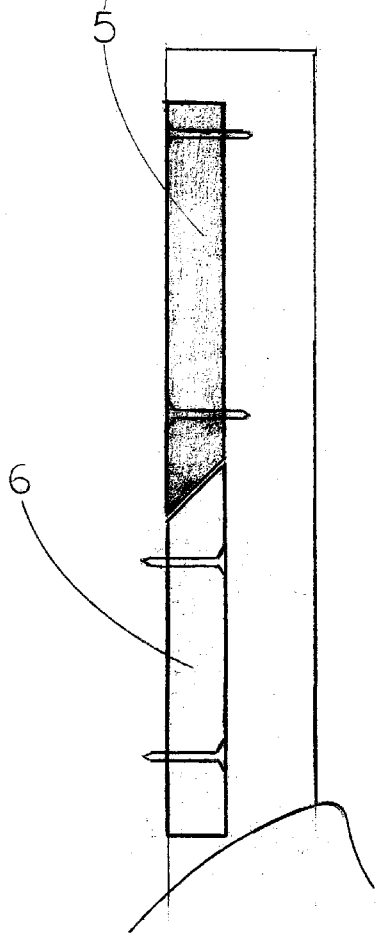
FIG. 4) End view of frame and wall cleat.

FIG. 4, shows the end view of a (5) frame cleat and a (6) wall cleat. The frame and wall cleats are cut to length and the frame cleat attaches to the frame in FIG. 3 and the (6) wall cleat attaches to the wall at the time of installation.

Figure 5:
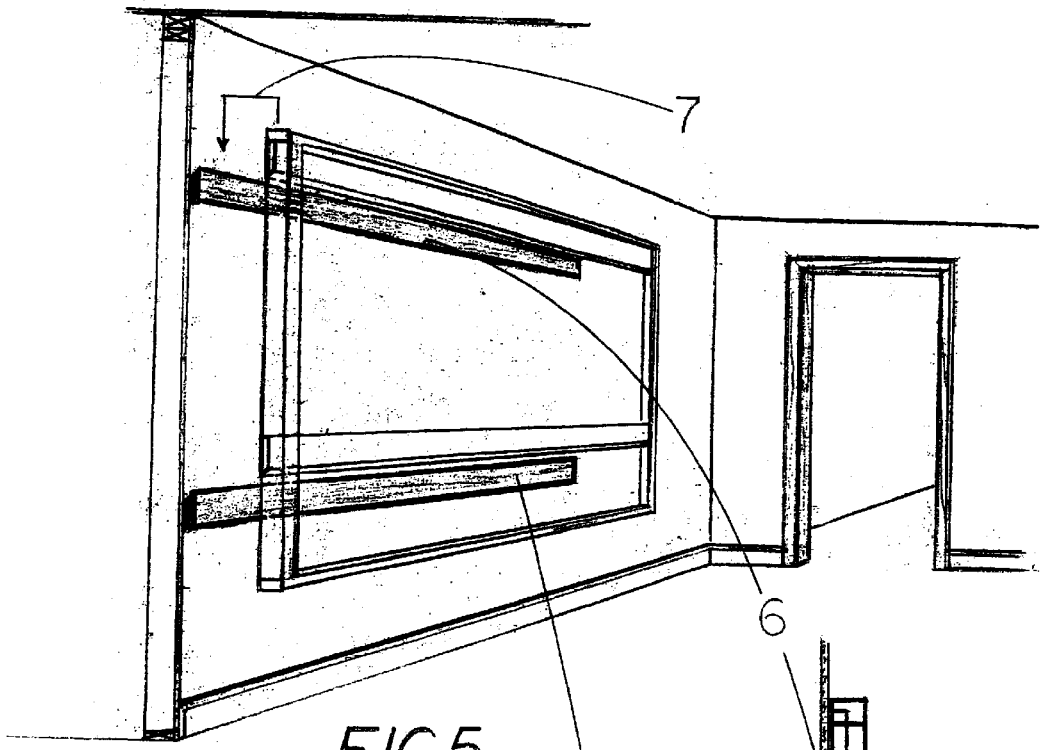
FIG. 5) Front view of frame and wall cleat.

FIG. 5, shows (6) wall cleat attached to the wall and how the frame and wall cleat (7) come together.

Figure 6:
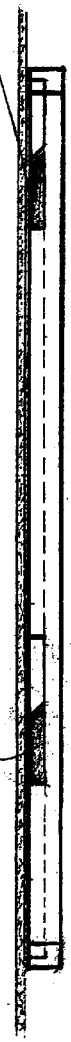
FIG. 6) End view of two sets of frame and wall cleats.

FIG. 6, shows an end view of two (5) frame and (6) wall cleats. Frames with heights over two feet require a second frame wall cleat.

Figure 7:
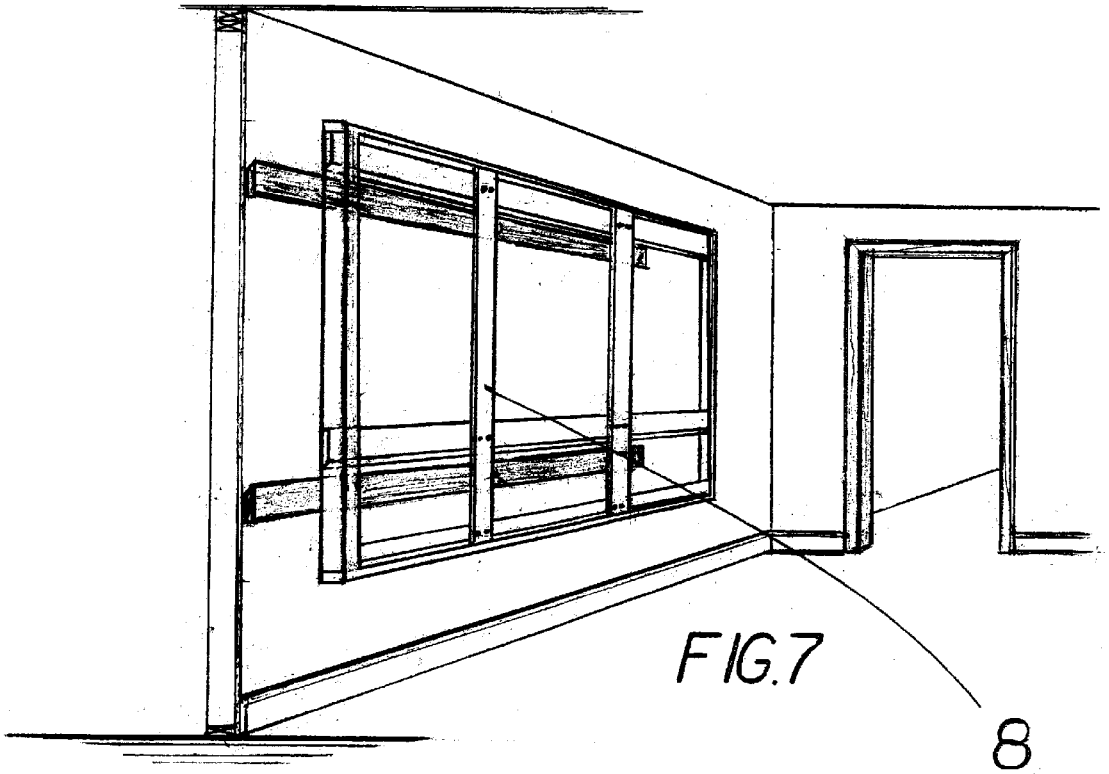
FIG. 7) Front view of vertical supports mounted to frame.

FIG. 7, shows (8) vertical supports attached to the frame cleats. Vertical supports are used on frames over six feet in length.

Figure 8:
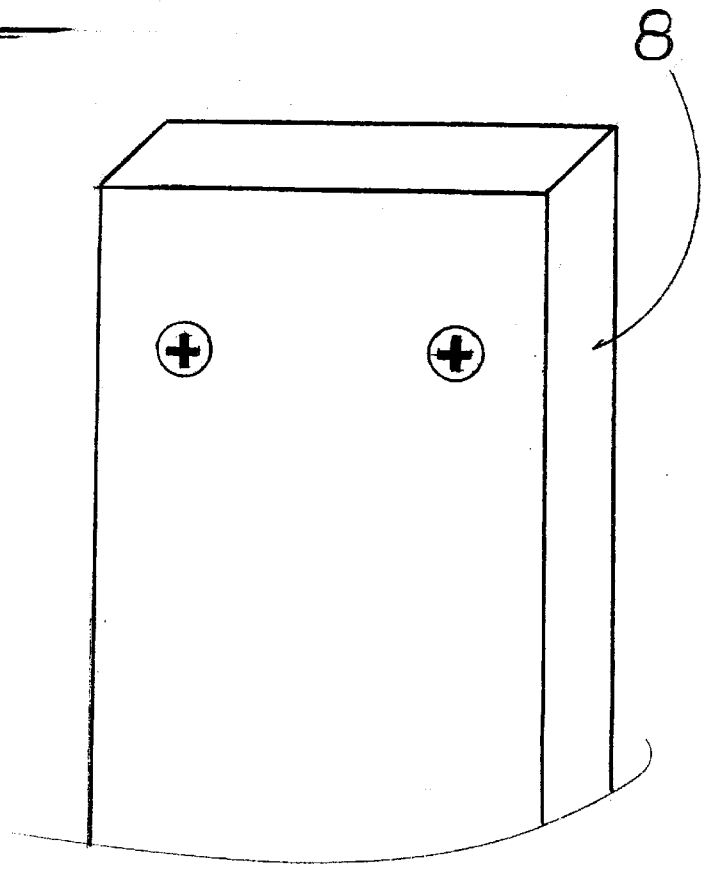
FIG. 8) Front view of vertical support.

FIG. 8, shows front view of a vertical support piece. The (8) vertical supports attach to the frame cleats and the bottom of the frame.

Figures 9, 10:
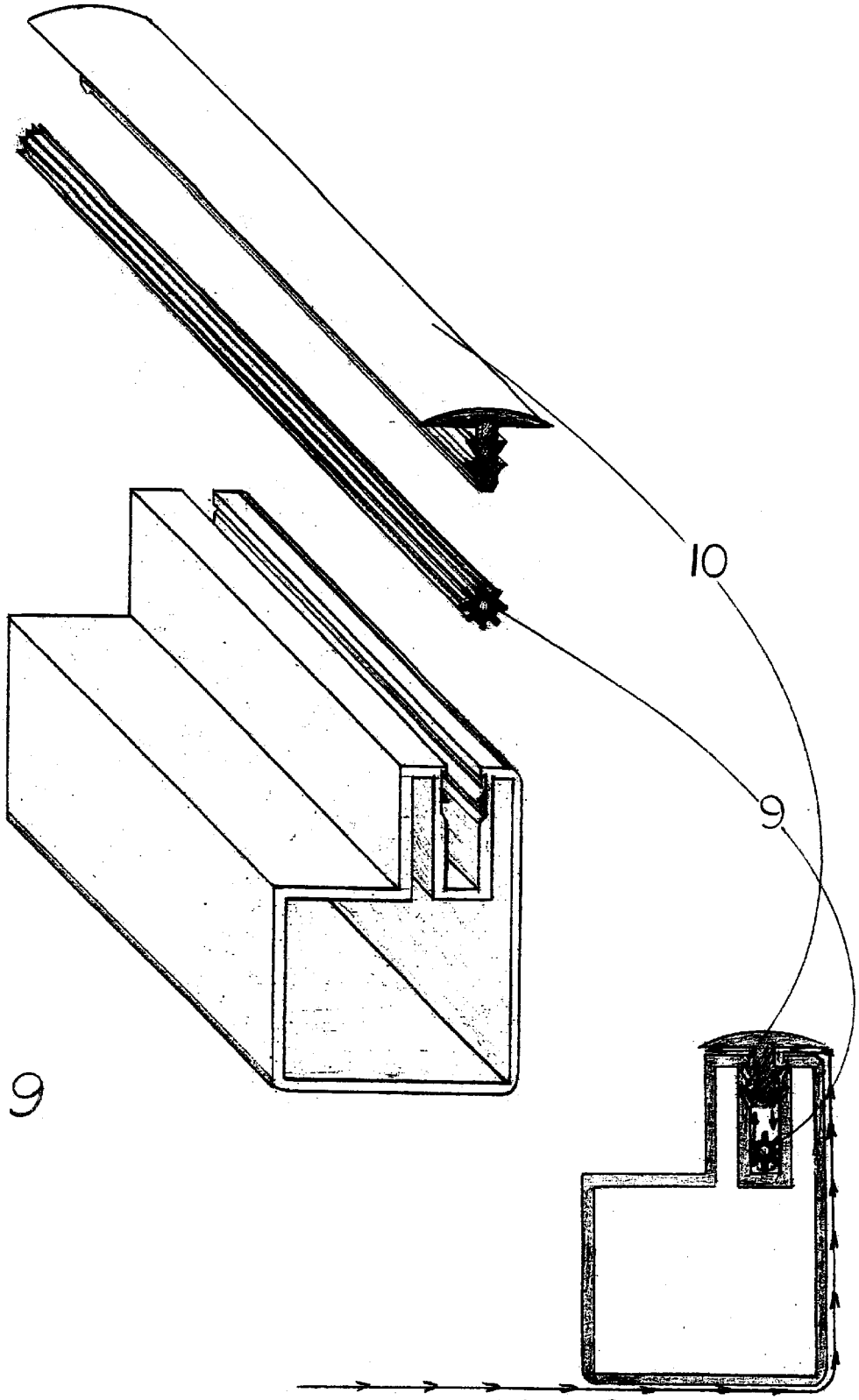
FIG. 9) View of rail, spline, rail coping.
FIG. 10) End view of rail, canvas, spline, rail coping, assembled.

FIG. 9, shows aluminum rail, (9) rubber spline and (10) plastic rail coping.

FIG. 10, shows canvas or vinyl indicated by wrapping over the face of the frame, around the edge, then pulled over the groove and pushed down into the groove. The spline is pushed into the groove and the rail coping is pushed into place and protects the wall from the frame.

Figure 11:
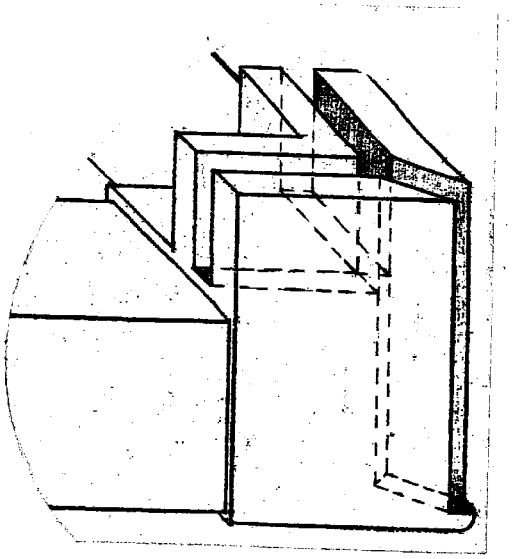
FIG. 11) View of corner piece and corner cap.

FIG. 11, shows the corner piece and (12) corner cap.

Figure 12:
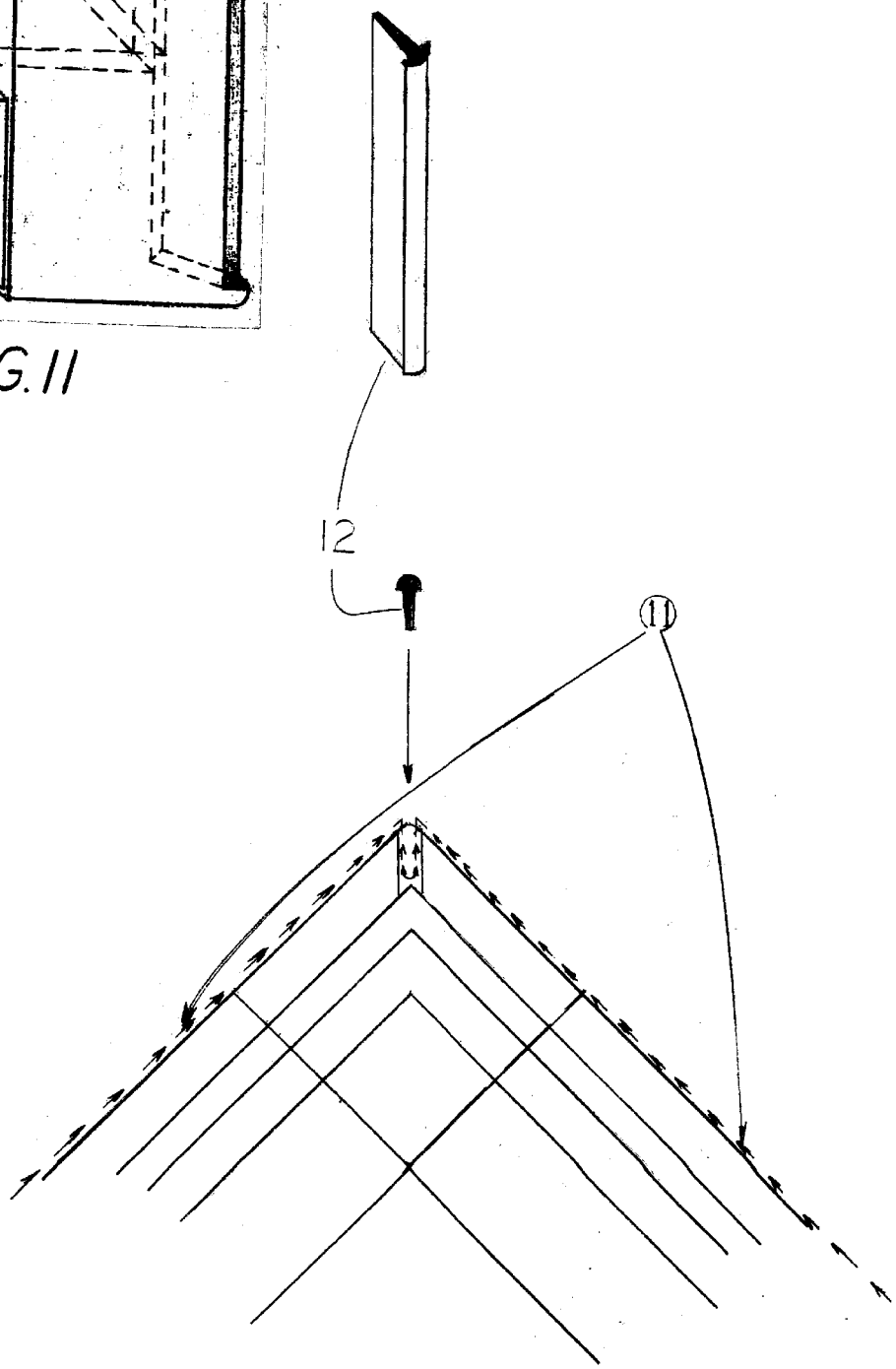
FIG. 12) Back view of corner piece canvas, corner cap.

FIG. 12, shows the (11) canvas or vinyl wrapped around and tucked into the corner. (12) The corner cap is pushed into the corner groove and holds the canvas or vinyl tightly.

What is claimed is:

1. A framing system for a flexible sheet of material comprising: a top, bottom, and pair of end rails defining a frame adapted to have the material wrapped on a front side thereof, the rails being aluminum and each having an opening; aluminum corner pieces slidably received within the opening of the rails and secured thereto; the rails including a groove on a back side thereof; a rubber spline element and plastic rail coping received in the rail groove and adapted to secure the material within the rail groove; the corner pieces including slots adapted to tuck the material therein and a corner cap received within one of the slots adapted to secure the material to the corner piece; plastic frame and wall cleats, the frame cleats adapted to slide downward onto the wall cleats for mounting the frame to a wall; and vertical supports attached to the frame cleats and the bottom rail of the frame.

* * * * *